US009930917B2

(12) United States Patent
Chen

(10) Patent No.: US 9,930,917 B2
(45) Date of Patent: Apr. 3, 2018

(54) BREAK-PROOF ASSEMBLY FOR WIRE OF TEMPERATURE CONTROL SWITCH OF HEATED CLOTHING

(71) Applicant: MEC ADDHEAT CO., LTD., Tainan (TW)

(72) Inventor: Chien-Chou Chen, Tainan (TW)

(73) Assignee: MEC Addheat Co., Ltd., Tainan (TW)

( * ) Notice: Subject to any disclaimer, the term of this patent is extended or adjusted under 35 U.S.C. 154(b) by 292 days.

(21) Appl. No.: 14/801,993

(22) Filed: Jul. 17, 2015

(65) Prior Publication Data

US 2017/0013889 A1 Jan. 19, 2017

(51) Int. Cl.

| | |
|---|---|
| ***H05B 3/00*** | (2006.01) |
| ***A41D 13/005*** | (2006.01) |
| ***H05B 1/02*** | (2006.01) |

(52) U.S. Cl.

CPC ..... *A41D 13/0051* (2013.01); *H05B 1/0272* (2013.01)

(58) Field of Classification Search

CPC ..... A41D 13/001; A41D 13/0058; A41D 13/008; A41D 13/012; A41D 13/005; A41D 27/06; A41D 27/12; A41D 27/208; H05B 1/0272; H05B 3/04; H05B 3/06; H05B 3/10; H05B 3/16; H05B 3/18; H05B 3/20; H05B 3/22; H05B 3/26; H05B 3/267; H05B 3/28; H05B 3/286; H05B 3/34; H05B 3/36; H05B 3/40; H05B 3/46; H05B 3/48; H05B 3/54

See application file for complete search history.

(56) References Cited

U.S. PATENT DOCUMENTS

2005/0007406 A1* 1/2005 Haas ..... A41D 13/0051 347/17

* cited by examiner

*Primary Examiner* — Shawntina Fuqua
(74) *Attorney, Agent, or Firm* — Rosenberg, Klein & Lee

(57) ABSTRACT

A break-proof assembly for wires of a temperature control switch of a heated clothing is revealed. Several first wires are extended from a switch body of the temperature control switch of the heated clothing and connected to second wires respectively while the second wires are connected to a heating plate of the heated clothing. A first end of a protective pad is connected to an edge of the switch body and extended toward a second end thereof to cover a part of the first wire outside the switch body. Thereby the first wires and the edge of the switch body are connected to one part to prevent breakage of the first wires caused by wear between the edge of the switch body and the first wires. Therefore the heated clothing can be washed directly in a washer and convenience in use is improved.

10 Claims, 5 Drawing Sheets

BREAK-PROOF ASSEMBLY FOR WIRE OF TEMPERATURE CONTROL SWITCH OF HEATED CLOTHING

BACKGROUND OF THE INVENTION

Field of the Invention

The present invention relates to a break-proof assembly for wires of a temperature control switch of a heated clothing, especially to a break-proof assembly for wires of a temperature control switch of a heated clothing that is durable to a strong pulling force for preventing breakage of wires connected to the temperature control switch.

Descriptions of Related Art

When a heated clothing is dirty or stained, users usually throw the heated clothing into a washer for washing and dehydration. However, most of the heated clothing gets heavy damage during the cleaning process. The problem is in a temperature control switch sewn on the heated clothing. During the washing and dehydration process, the heated clothing is stirred and pulled by a strong force. Thus wires of a control unit extended from a switch body of the temperature control switch are cut and broken by a sharp edge of the temperature control switch with higher hardness due to repetitive friction therebetween. Moreover, a connection portion between wires of the control unit and wires of a heating plate is also easy to be broken. This is due to low structural strength at this site.

In order to prevent damages of the heated clothing resulted from a strong pulling force during the washing and dehydration process, the heated clothing available now can be cleaned only by moderate hand washing. However, hand washing is not only lack of efficiency but also causing inconvenience in people's lives. Some users are still used to put the heated clothing into the washer and the heated clothing is often damaged by washing. Thus there is room for improvement.

SUMMARY OF THE INVENTION

Therefore it is a primary object of the present invention to provide a break-proof assembly for wires of a temperature control switch of a heated clothing that is durable to a strong pulling force for preventing wires connected to the temperature control switch from being damaged and broken.

In order to achieve the above object, a break-proof assembly for wires of a temperature control switch of a heated clothing according to the present invention includes a protective pad arranged at a contact area between an edge of a switch body of the temperature control switch and first wires of the control unit. A first end of the protective pad is connected to the edge of the switch body and is extended toward an opposite second end thereof while the second end of the protective pad is located at a part of the first wire outside the switch body to cover the part of the first wire outside the switch body. Thereby the first wires and the edge of the switch body are integrated into one part for preventing breakage of the first wires of the temperature control switch caused by a pulling force.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
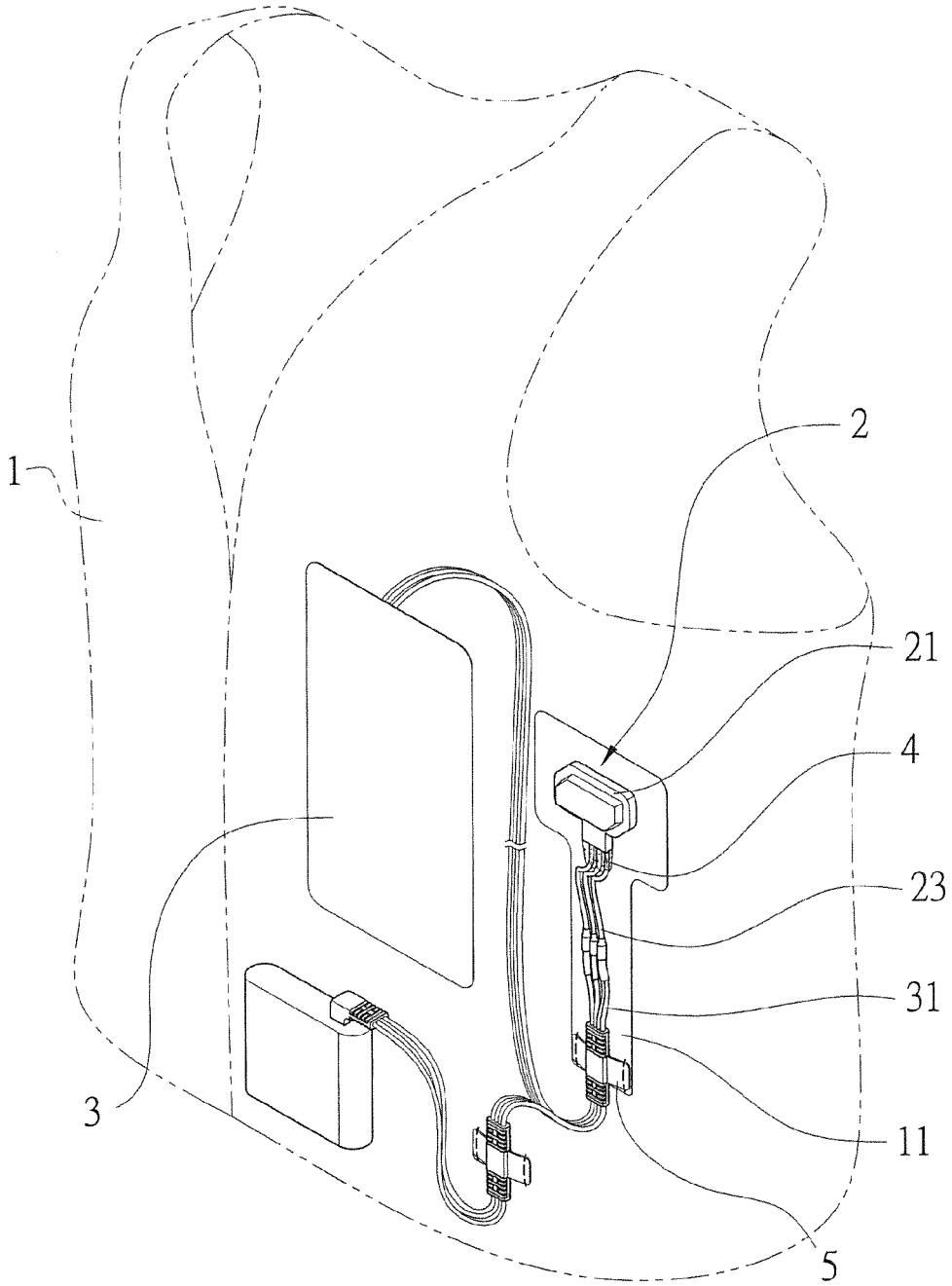
FIG. 1 is a perspective view of an embodiment according to the present invention.

Refer to FIG. 1, a break-proof assembly for wires of a temperature control switch of a heated clothing of the present invention mainly includes a heated clothing 1 disposed with a temperature control switch 2. Also refer to FIG. 4 and FIG. 5, a control unit 22 is mounted in a receiving space 211 of a switch body 21 of the temperature control switch 2 while a fixing member 24 is arranged at a rear surface of the switch body 21. Both the fixing member 24 and the switch body 21 are made from silicone. The melted fixing member 24 is poured into the receiving space 211 of the switch body 21. After cooling, the control unit 22 is packed in the receiving space 211. A plurality of first wires 23 connected to the control unit 22 is extended from the edge of the switch body 21 and is further connected to a plurality of second wires 31 correspondingly. The second wires 31 are connected to a heating plate 3 in the heated clothing 1. The assembly features on a protective pad 4.

Figure 2:
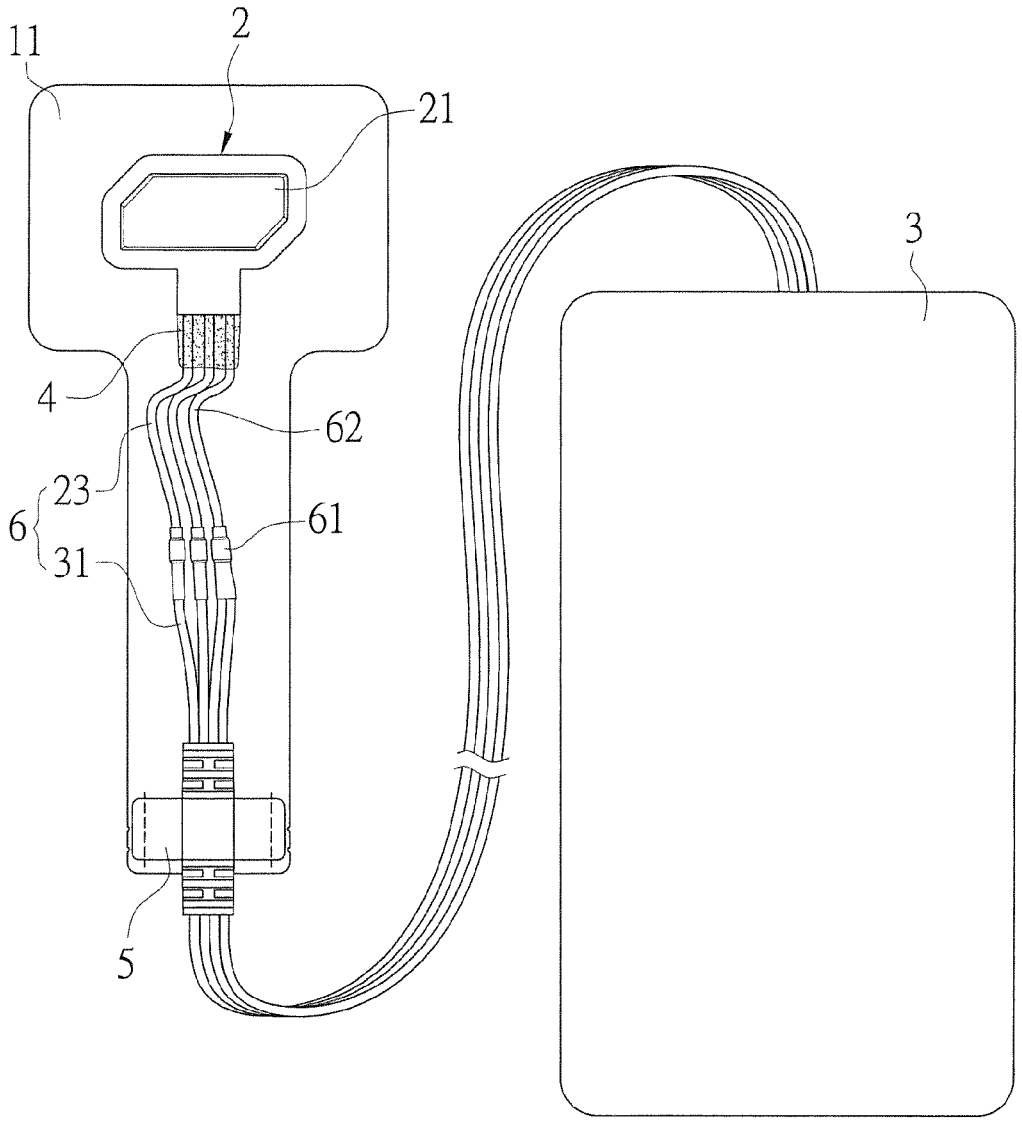
FIG. 2 is a front view of a temperature control switch and a heating plate of an embodiment according to the present invention.
Figure 3:
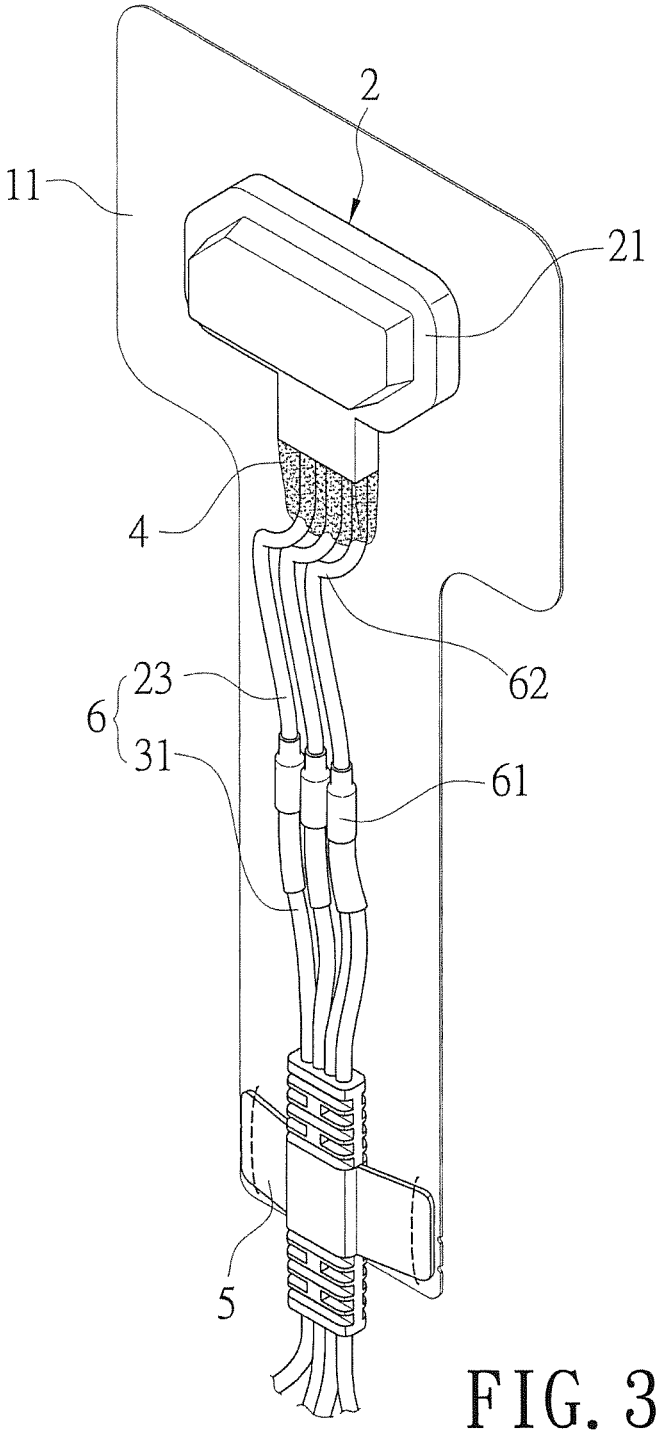
FIG. 3 is perspective view of a temperature control switch of an embodiment according to the present invention.
Figure 4:
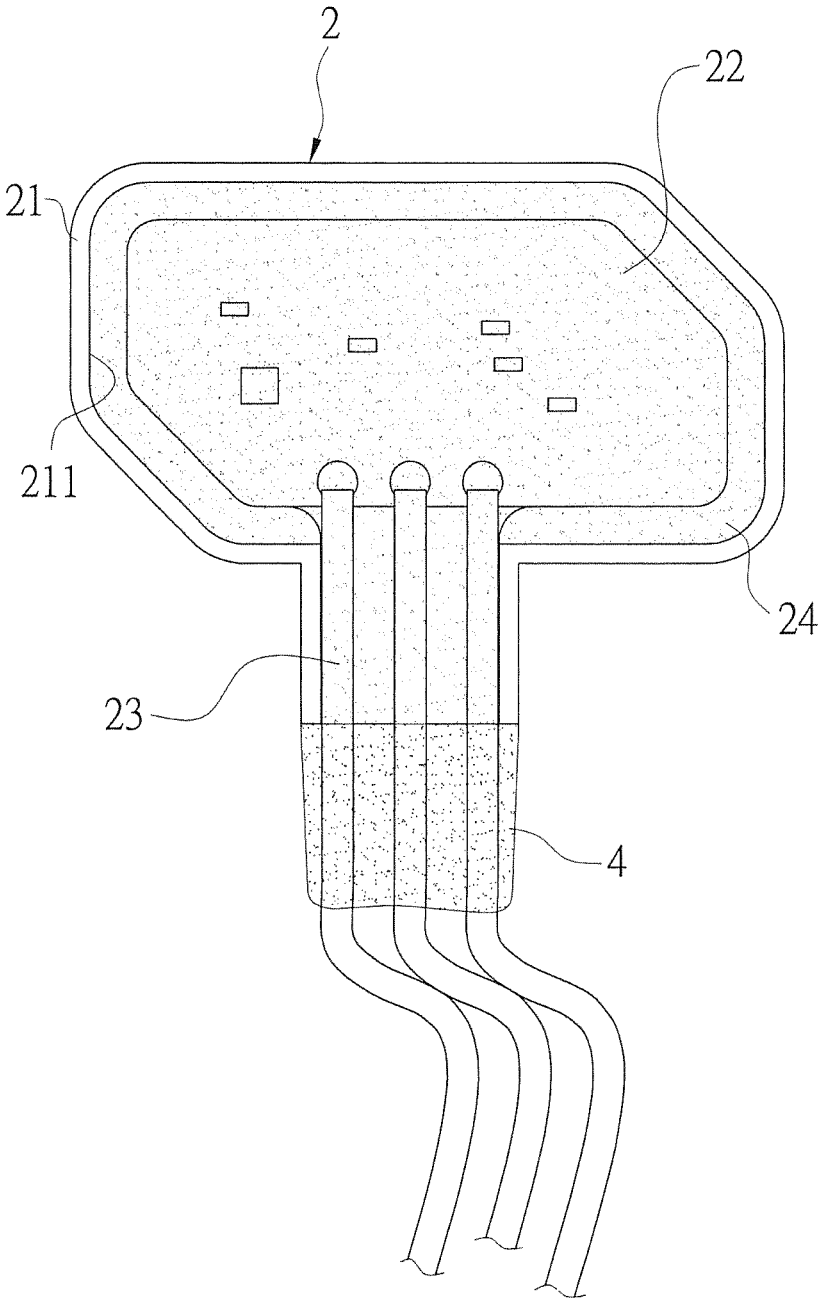
FIG. 4 is rear view of a temperature control switch of an embodiment according to the present invention.
Figure 5:
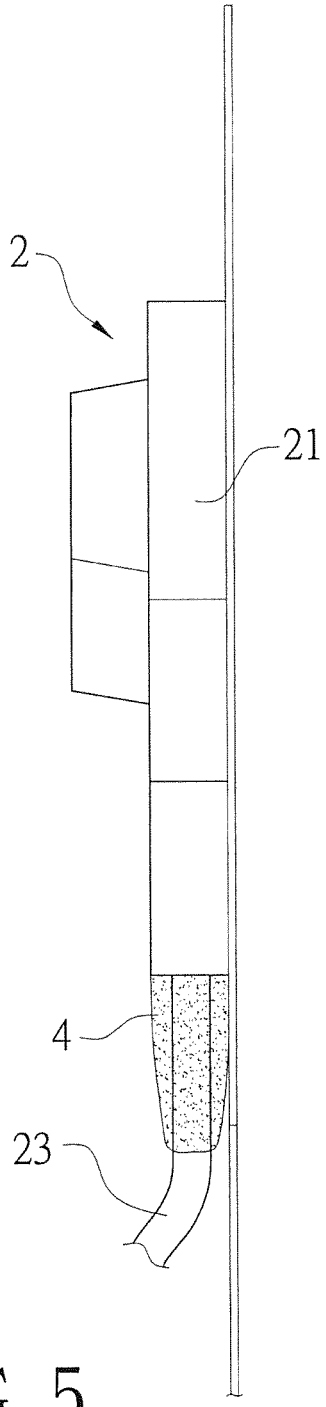
FIG. 5 is a side view of a temperature control switch of an embodiment according to the present invention.

Refer to FIG. 2 and FIG. 3, the protective pad 4 is disposed on a contact area between the edge of the switch body 21 of the temperature control switch 2 and the first wires 23 connected to the control unit 22. A first end of the protective pad 4 is connected to the edge of the switch body 21 and is extended toward an opposite second end of the protective pad 4 while the second end of the protective pad 4 is located at and covered a part of the first wires 23 outside the switch body 21. The optimal length between the first end and the second end of the protective pad 4 is 10 cm. The thickness of the protective pad 4 is tapered from the first end thereof to the second end thereof, as shown in FIG. 4. The protective pad 4 can be made from silicon and the hardness of the material of the protective pad 4 is lower than that of the switch body 21 and the fixing member 24. In an embodiment of the present invention, the hardness of the material for the protective pad 4 is one-second (½) to one-third (⅓) of the hardness of the material for the switch body 21 and the fixing member 24.

Moreover, a fixing member 5 is arranged at the second wires 31 connected to the heating plate 3. The switch body 21 of the temperature control switch 2 and the fixing member 5 are fixed on an assembly piece 11 sewn on the heated clothing 1. A wire assembly portion 6 is formed by a part of the first wires 23 and a part of the second wires 31, both located between the switch body 21 of the temperature control switch 2 and the fixing member 5. A connection part 61 where the first wire 23 and the second wire 31 are connected to each other is on the wire assembly portion 6. The length of the wire assembly portion 6 is longer than the distance between the switch body 21 of the temperature control switch 2 and the fixing member 5. Thus the wire assembly portion 6 between the switch body 21 of the temperature control switch 2 and the fixing member 5 is curved. The connection part 61 that connects the first wire 23 and the second wire 31 is away from a bending portion 62 of the wire assembly portion 6.

When the heated clothing 1 equipped with the present invention needs to be washed for removing stains and dirt, the heated clothing 1 is directly placed into a washing machine to be stirred vigorously, rubbed and dehydrated. In the heated clothing 1, the edge of the switch body 21 of the temperature control switch 2 and the first wires 23 are integrated into one part by the design of the second end of the protective pad 4 located at the edge of the switch body 21 and covered the first wires 23 of the control unit 22. Thus the first wires 23 and the switch body 21 will not be moved in relation to each other. Therefore the first wires 23 will not be rubbed and broken by the edge of the switch body 21 with higher hardness and sharp shape. Moreover, the plurality of wires 23 is wrapped by the protective pad 4 so as to increase the tensile strength of the first wires 23. Thus the first wires 23 will not get damaged easily. Due to soft material for the protective pad 4 and the tapered thickness from the first end to the second end with the first wires 23 thereof, the first wires 23 at the second end of the protective pad 4 will not be rubbed and broken.

Furthermore, when the connection part 61 between the first wires 23 of the temperature control switch 2 and the second wires 31 of the heating plate 3 is pulled by a strong force of the washing machine, the wire assembly portion 6 can be stretched or tightened for buffering the pulling force applied due to the curved design of the wire assembly portion 6 between the switch body 21 of the temperature control switch 2 and the fixing member 5. The pulling force is mainly acted on the bending portion 62 of the wire assembly portion 6. In the present invention, the connection part 61 that connects the first wire 23 and the second wire 31 is away from the bending portion 62. This arrangement prevents the connection part 61 with lower structural strength from being pulled by the pulling force. Thus the first wire 23 and the second wire 31 will not be broken at this site.

In summary, when the heated clothing 1 is dirty or stained, it can be thrown into the washing machine directly for cleaning. The first wires 23 and the second wires 31 located at the temperature control switch 2 will not be damaged due to vigorous pulling and stirring. Thus the washing of the heated clothing 1 is more convenient. Moreover, when the user wears the heated clothing 1 to do some strenuous or vigorous exercise, the design can also protect the first wires 23 and the second wires 31 located at the temperature control switch 2 from damages caused by the pulling force generated during the strenuous or vigorous exercise. The service life of the heated clothing 1 is also prolonged.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A break-proof assembly for wires of a temperature control switch of a heated clothing comprising:

a heated clothing disposed with a temperature control switch;

a control unit mounted in a switch body of the temperature control switch;

at least one first wire connected to the control unit and extended from an edge of the switch body so as to connect at least one second wire correspondingly and the second wire connected to a heating plate of the heated clothing;

wherein a protective pad is disposed on a contact area between the edge of the switch body and the first wire of the control unit; a first end of the protective pad is connected to the edge of the switch body while the protective pad is extended from a first end thereof to an opposite second end thereof; the second end of the protective pad is located at a part of the first wire outside the switch body so as to cover the part of the first wire outside of the switch body; a thickness of the protective pad is tapered from the first end thereof to the second end thereof.

2. The assembly as claimed in claim 1, wherein a hardness of the protective pad is lower than a hardness of the switch body.

3. The assembly as claimed in claim 2, wherein the hardness of the protective pad is one-second (½) to one-third (⅓) of the hardness of the switch body.

4. The assembly as claimed in claim 1, wherein a fixing member is arranged at the second wire that is connected to the heating plate; the switch body of the temperature control switch and the fixing member are fixed on the heated clothing; a wire assembly portion having a part of the first wire located between the switch body of the temperature control switch and the fixing member and a part of the second wires located between the switch body of the temperature control switch and the fixing member; a connection point where the first wire and the second wire are connected to each other is on the wire assembly portion; a length of the wire assembly portion is longer than a distance between the switch body and the fixing member; whereby the wire assembly portion between the switch body and the fixing member is curved.

5. The assembly as claimed in claim 4, wherein a bending portion is formed on the wire assembly portion; the connection point where the first wire and the second wire are connected to each other is away from the bending portion of the wire assembly portion.

6. The assembly as claimed in claim 4, wherein the heated clothing further includes an assembly piece sewn thereon while the switch body of the temperature control switch and the fixing member are fixed on and connected to the assembly piece of the heated clothing.

7. A break-proof assembly for wires of a temperature control switch of a heated clothing comprising:

a heated clothing disposed with a temperature control switch;

a control unit mounted in a switch body of the temperature control switch;

at least one first wire connected to the control unit and extended from an edge of the switch body so as to connect at least one second wire correspondingly and the second wire connected to a heating plate of the heated clothing; and a protective pad disposed on a contact area between the edge of the switch body and the first wire of the control unit, the protective pad having a hardness lower than a hardness of the switch body and a first end connected to the edge of the switch body while the protective pad is extended from a first end thereof to an opposite second end thereof, the second end of the protective pad being located at a part of the first wire outside the switch body to cover the part of the first wire outside of the switch body.

8. The assembly as claimed in claim 7, wherein the hardness of the protective pad is one-second (½) to one-third (⅓) of the hardness of the switch body.

9. A break-proof assembly for wires of a temperature control switch of a heated clothing comprising:

a heated clothing disposed with a temperature control switch, the heated clothing including an assembly piece sewn thereon;

a control unit mounted in a switch body of the temperature control switch;

at least one first wire connected to the control unit and extended from an edge of the switch body so as to connect at least one second wire correspondingly and the second wire connected to a heating plate of the heated clothing;

a protective pad disposed on a contact area between the edge of the switch body and the first wire of the control unit, the protective pad having a first end connected to the edge of the switch body while the protective pad is extended from a first end thereof to an opposite second end thereof, the second end of the protective pad being located at a part of the first wire outside the switch body to cover the part of the first wire outside of the switch body;

a fixing member arranged at the second wire that is connected to the heating plate, the switch body of the temperature control switch and the fixing member being fixed on and connected to the assembly piece of the heated clothing;

a wire assembly portion having a part of the first wire located between the switch body of the temperature control switch and the fixing member and a part of the second wires located between the switch body of the temperature control switch and the fixing member;

a connection point where the first wire and the second wire are connected to each other being disposed on the wire assembly portion, a length of the wire assembly portion being longer than a distance between the switch body and the fixing member, whereby the wire assembly portion between the switch body and the fixing member is curved.

10. The assembly as claimed in claim 9, wherein a bending portion is formed on the wire assembly portion; the connection point where the first wire and the second wire are connected to each other is away from the bending portion of the wire assembly portion.

* * * * *